United States Patent [19]

Ragan

[11] Patent Number: 4,479,285

[45] Date of Patent: Oct. 30, 1984

[54] COTTON MODULE DISPERSING AND FEEDING SYSTEM WITH IMPROVED ELECTRICAL CONTROLS

[75] Inventor: Eddie D. Ragan, Slaton, Tex.

[73] Assignee: Continental Conveyor & Equipment Co., Inc., Sherman, Tex.

[21] Appl. No.: 310,209

[22] Filed: Oct. 9, 1981

[51] Int. Cl.[3] ..... D01G 7/08

[52] U.S. Cl. ..... 19/64.5; 19/80 R; 19/81

[58] Field of Search ..... 19/64.5, 80 R, 81

[56] References Cited

U.S. PATENT DOCUMENTS

| | | | |
|---|---|---|---|
| 3,110,062 | 11/1963 | Wildbolz et al. | 19/80 R |
| 3,978,552 | 9/1976 | Araki et al. | 19/80 R |
| 4,109,875 | 8/1978 | Condarco et al. | 19/80 R |
| 4,117,571 | 10/1978 | Prather | 19/64.5 |
| 4,202,079 | 5/1980 | Prather | 19/80 R |
| 4,214,347 | 7/1980 | Prather | 19/80 R |
| 4,259,765 | 4/1981 | Trützschler | 19/80 R |
| 4,380,095 | 4/1983 | Walker et al. | 19/80 R |

*Primary Examiner*—Louis Rimrodt

*Attorney, Agent, or Firm*—Michael J. Colitz, Jr.

[57] ABSTRACT

A system for decompacting modules of compacted seed cotton. The system includes apparatus moveable through the compacted modules to feed the cotton to a remote location for further processing. Improved electronic controls permit automatic activation of a containment door against the trailing face of the last module, automatic reversal of the apparatus after containment of the last module and automatic inactivation of the system in the event of a malfunction.

12 Claims, 5 Drawing Figures

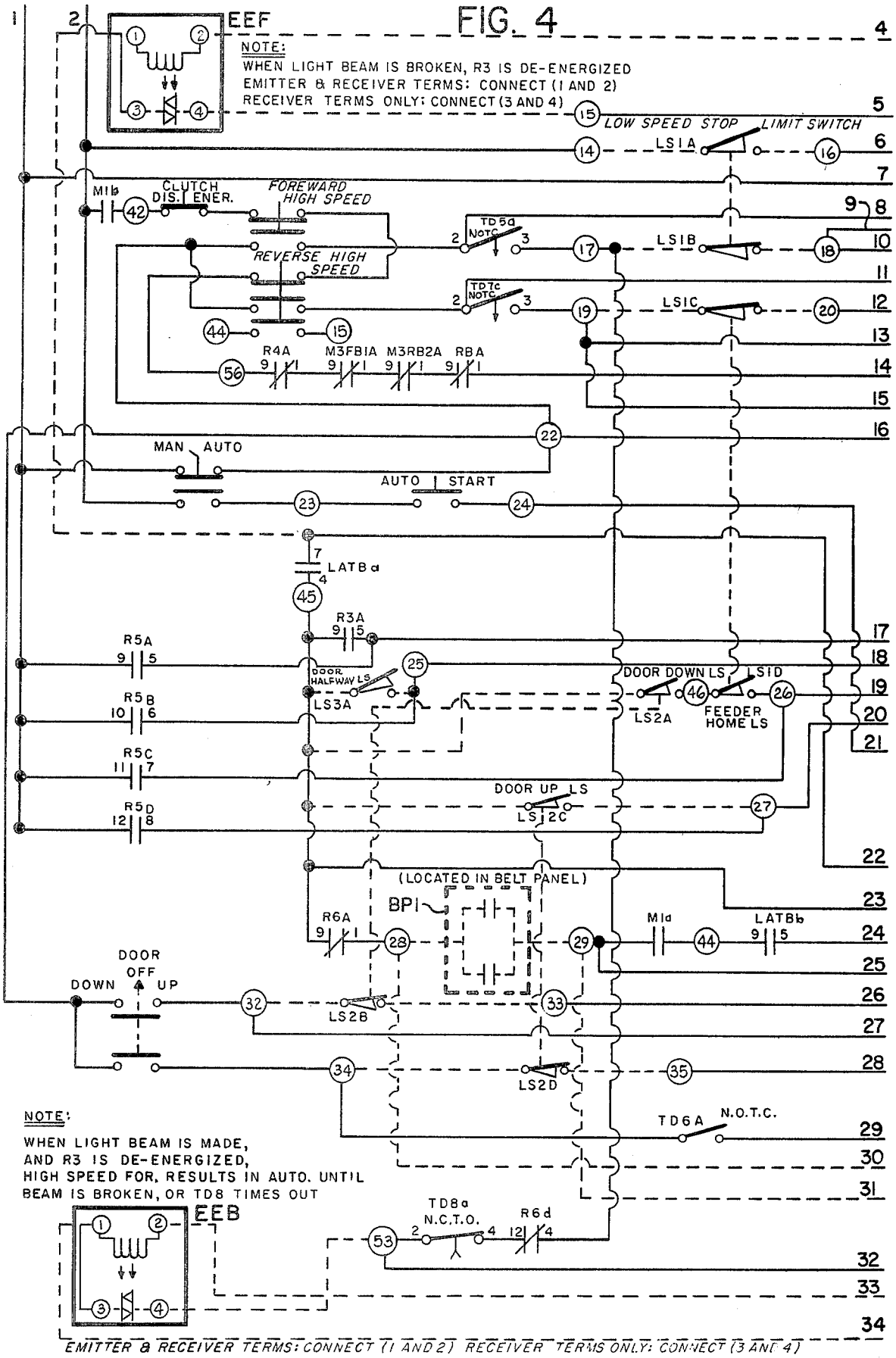
FIG. 4
EEF
NOTE:
WHEN LIGHT BEAM IS BROKEN, R3 IS DE-ENERGIZED
EMITTER & RECEIVER TERMS: CONNECT (1 AND 2)
RECEIVER TERMS ONLY: CONNECT (3 AND 4)
LOW SPEED STOP
LIMIT SWITCH
LS1A
M1b
CLUTCH
DIS. ENER.
FOREWARD HIGH SPEED
REVERSE HIGH SPEED
TD5a NOTC
TD7c NOTC
LS1B
LS1C
R4A
M3FB1A
M3RB2A
RBA
MAN
AUTO
AUTO START
LATBa
R3A
R5A
R5B
R5C
R5D
DOOR HALFWAY LS
LS3A
DOOR DOWN LS
LS1D
LS2A
FEEDER HOME LS
DOOR UP LS
LS2C
(LOCATED IN BELT PANEL)
BP1
R6A
M1a
LATBb
DOOR
OFF
DOWN
UP
LS2B
LS2D
TD6A
N.O.T.C.
NOTE:
WHEN LIGHT BEAM IS MADE,
AND R3 IS DE-ENERGIZED,
HIGH SPEED FOR, RESULTS IN AUTO. UNTIL
BEAM IS BROKEN, OR TD8 TIMES OUT
EEB
TD8a
N.C.T.O.
R6d
EMITTER & RECEIVER TERMS: CONNECT (1 AND 2) RECEIVER TERMS ONLY: CONNECT (3 AND 4)

COTTON MODULE DISPERSING AND FEEDING SYSTEM WITH IMPROVED ELECTRICAL CONTROLS

BACKGROUND OF THE INVENTION

This invention relates to dispersing compacted modules of seed cotton and feeding the dispersed seed cotton to a cotton gin. More specifically, this invention relates to a system with improved electrical controls for dispersing or decompacting and then feeding seed cotton from compacted modules to cotton gins.

In the prior art there are disclosed systems including a movable apparatus for dispersing and feeding seed cotton from compacted modules to a gin. In such prior art devices, as described for example in U.S. Pat. No. 4,109,875 to Condarco, et al, manual controls are provided which require the constant attention of operators to safely and effectively control such systems. Other prior art systems which are used for dispersing and feeding modules of seed cotton are disclosed in patents to Prather, as for example U.S. Pat. No. 4,214,347. In no prior art cotton module dispersing and feeding system, however, are controls utilized to render the operation of such device automatic so as to minimize the involvement of the operators. Further, no prior art system is operable, whereby an operator may select between a manual and automatic mode of operation.

The present invention is designed to operate to disperse seed cotton from compacted modules and to convey or feed the dispersed seed cotton to a cotton gin for further processing. The instant invention permits operation with minimum operator involvement and maximum safety while permitting an alternate electrical arrangement to allow operation of the system in the non-automatic or manual mode.

One of the key elements in the automatic controls is the utilization of electric eyes in the module dispersing and feeding apparatus to sense the presence or absence of a cotton module to be dispersed and to permit cotton module dispersement and feeding or stoppage of the apparatus upon the presence or absence of such module. The electric eye arrangement and associated electric controls also activate the back-up or containment door at the appropriate time to a closed position adjacent the trailing face of the last module to provide a physical support for the module. The use of the electric eyes also serves to prevent premature movement of a back-up door into position against the trailing face of the last module as the apparatus moves over the cotton modules from the leading edge of the first module toward the trailing end of the last module. The electric eyes also permits the fast movement of the apparatus up to the leading face of the first module then slow movement during the dispersing and feeding operation.

By use of the automatic controls, the cotton module feeding apparatus can be utilized more efficiently in a time effective manner with the minimum need for the involvement of operators along with the reduction of the possibility of human error in controlling the various functioning elements of the system.

The specific nature of the invention as well as other objects and advantages thereof will become apparent from the following detailed description of the invention and from the accompanying drawings wherein:

FIGS. 3 through 5 are electrical schematic drawings of the control circuitry constructed in accordance with the instant invention for controlling the operation of the inventive cotton module dispersing and feeding apparatus and related mechanisms of the system.

The general arrangement of mechanical parts and controls for the cotton module feeding system and related mechanisms of the type disclosed herein can be had with reference to the aforementioned U.S. Pat. No. 4,109,875 to Condarco, et al. Such prior art devices are commercially available from The Continental Conveyor & Equipment Company, Inc., Sherman, Tex., and are being sold as the Feed-A-Matic TM cotton module machinery. Operation of such prior art devices, however, could only be effected in a manual mode. The operation of the above noted Condarco et al device, as well as that of the instant inventive device, when used in the manual mode, is substantially the same.

GENERAL MECHANICAL STRUCTURE

The major operational component of the cotton module dispersing and feeding system of the instant invention, as in the prior art devices, is the movable apparatus, shown in the figures as 10. The apparatus is provided with wheels 12, at least one of which is powered to cause movement on rails 14. A fixed slab or pad 16, of concrete or the like, supports the rails in position on opposite sides of the pad to define a path of movement for the apparatus 10.

Figure 1:
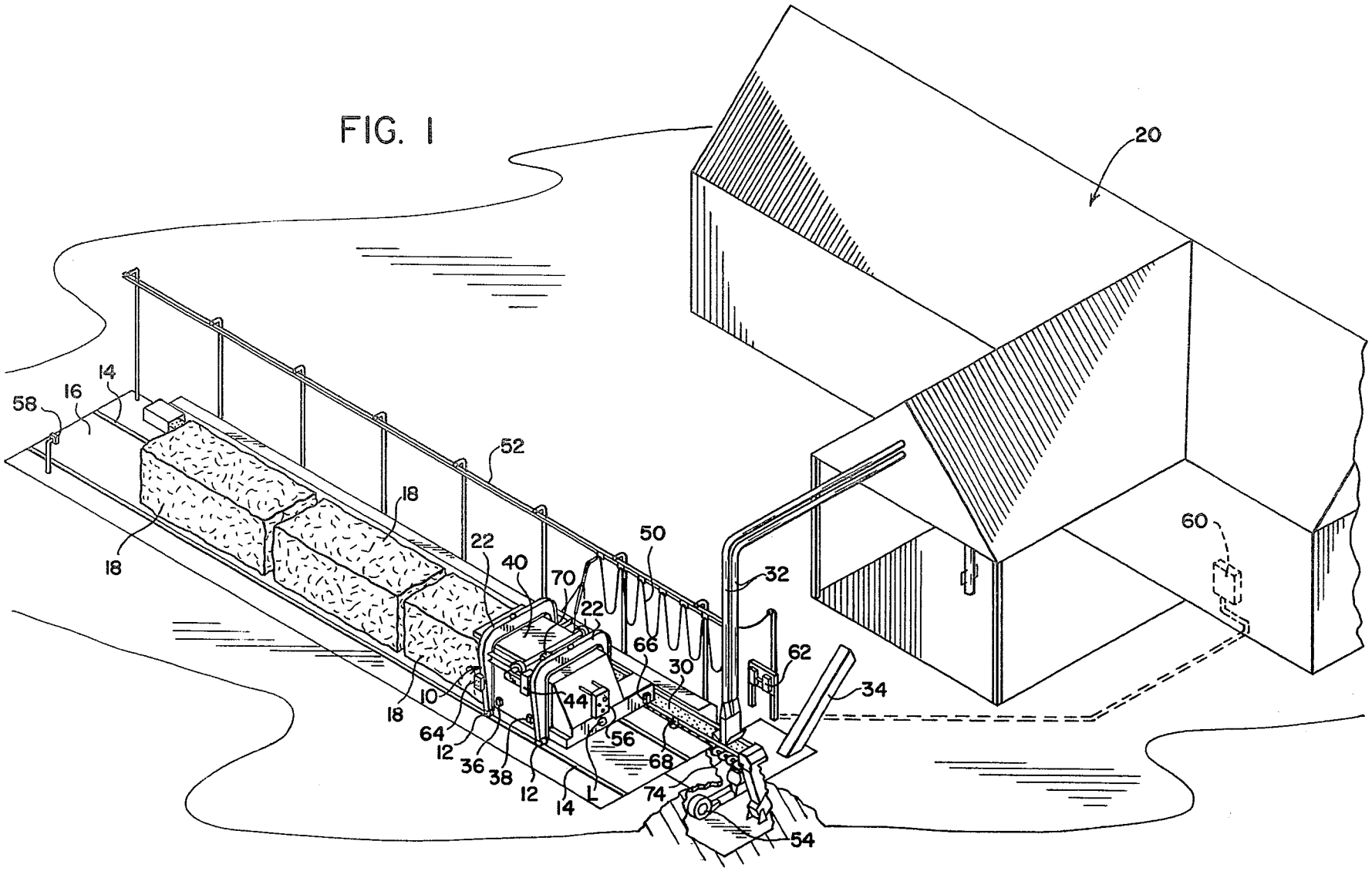
FIG. 1 shows a perspective view of the module cotton module dispersing and feeding system which constitutes the instant invention.

Shown positioned on the slab in FIG. 1 are a series of compacted modules 18 of seed cotton received from the cotton field. The modules are positioned on the pad to be processed by the apparatus moving along the rails and over the modules from its starting or home position, as shown in FIG. 1, to the opposite end of the pad at the end or finishing position. As the apparatus 10 moves along the rails it will contact the compacted cotton modules, decompact or disperse the cotton and feed it to a gin 20 for further processing.

Rigid framing supports 22 position the various functioning elements of apparatus in operative relationship one to another. Disperser cylinders 24 are journaled in side portions of the supports 22 for rotational motion whereby the fingers of the cylinders can contact and decompact or disperse the compacted modules which are brought into contact therewith as the apparatus moves along the rails. As the dispersed cotton moves from the disperser cylinders and falls, it is impelled by flighted rolls 26 to augers 28 which act as screw conveyors to move the cotton to one edge of the apparatus. At the edge is located a long conveyor belt 30 which conveys the dispersed cotton to a vacuum conveyor 32 for pneumatic conveying to the gin 20 for further processing. Beneath the cotton augers 28 may be positioned a gridded bottom sheet 46 through which the cotton will not fall. The apertures of the sheet, however, are of such size as to permit smaller trash to fall therethrough to contact augers 48 for matting small debris to a trough or channel under the long belt for conveying to vacuum motor 54. A supplemental conveyor system 34 removes larger particles of trash, debris, green bolls and errant cotton not vacuumed away by conveyor 32 to a trash or other receptacle in the conventional manner as to be described later. Also located on the apparatus, and to be described in greater detail later, are a front electric eye 36 and back electric eye 38, designated in the electrical description hereinafter as EEF and EEB.

At the end of the module apparatus is a module restraining or containment device, shown as door 40, pivotally mounted on machine supports 22. It is preferably provided with a counter weight 44 and is driven to rotate to the closed position adjacent the disperser cylinders to restrain the trailing face of the last module being dispersed. In operation it has been found desirable to reverse the movement of the apparatus and bring down the door from its raised or open position upon the moveable apparatus arriving at a predetermined position with respect to the trailing face of the last module and prior to the complete dispersing of the last module so as final dispersing may occur as the apparatus returns to the home position. Alternate door locations or positions could also be utilized.

Figure 2:
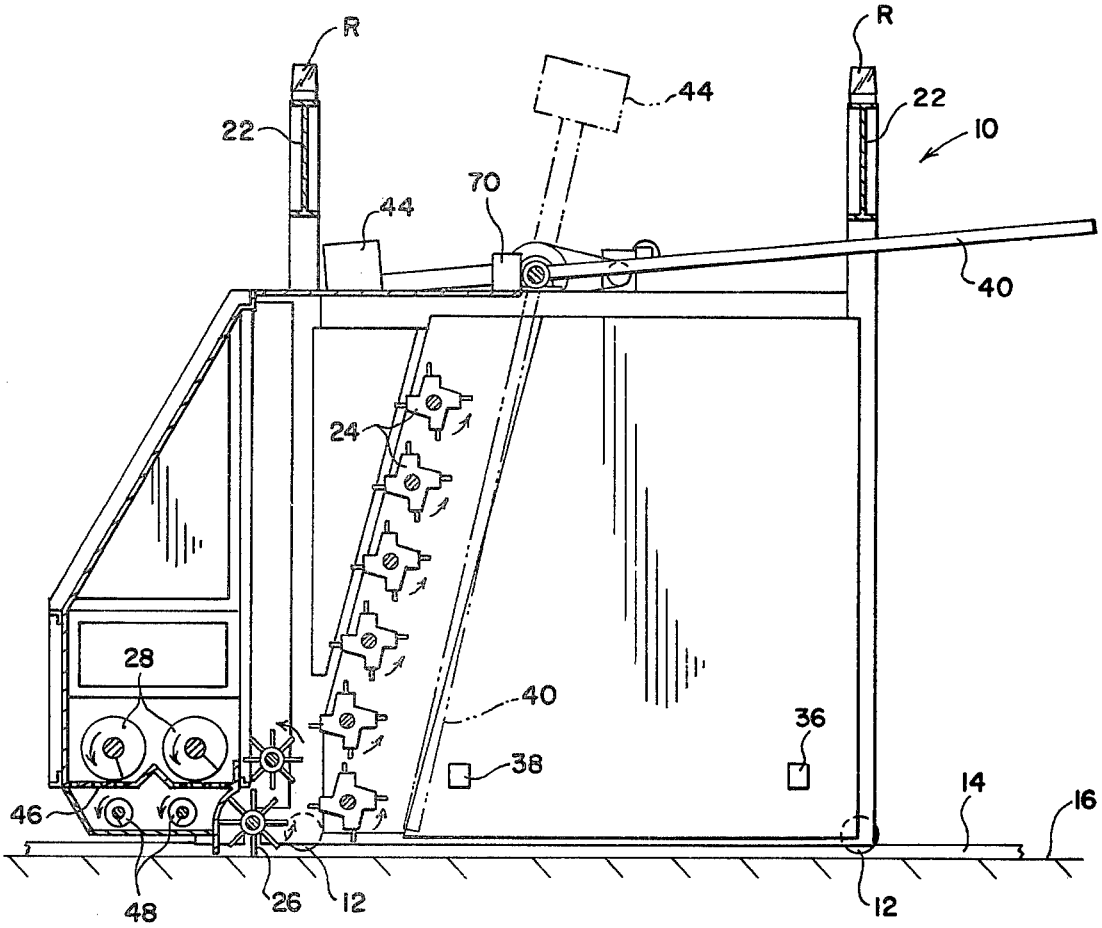
FIG. 2 is a side elevational view of the module apparatus of the system constructed in accordance with the preferred embodiment of the instant invention.
Figure 3:
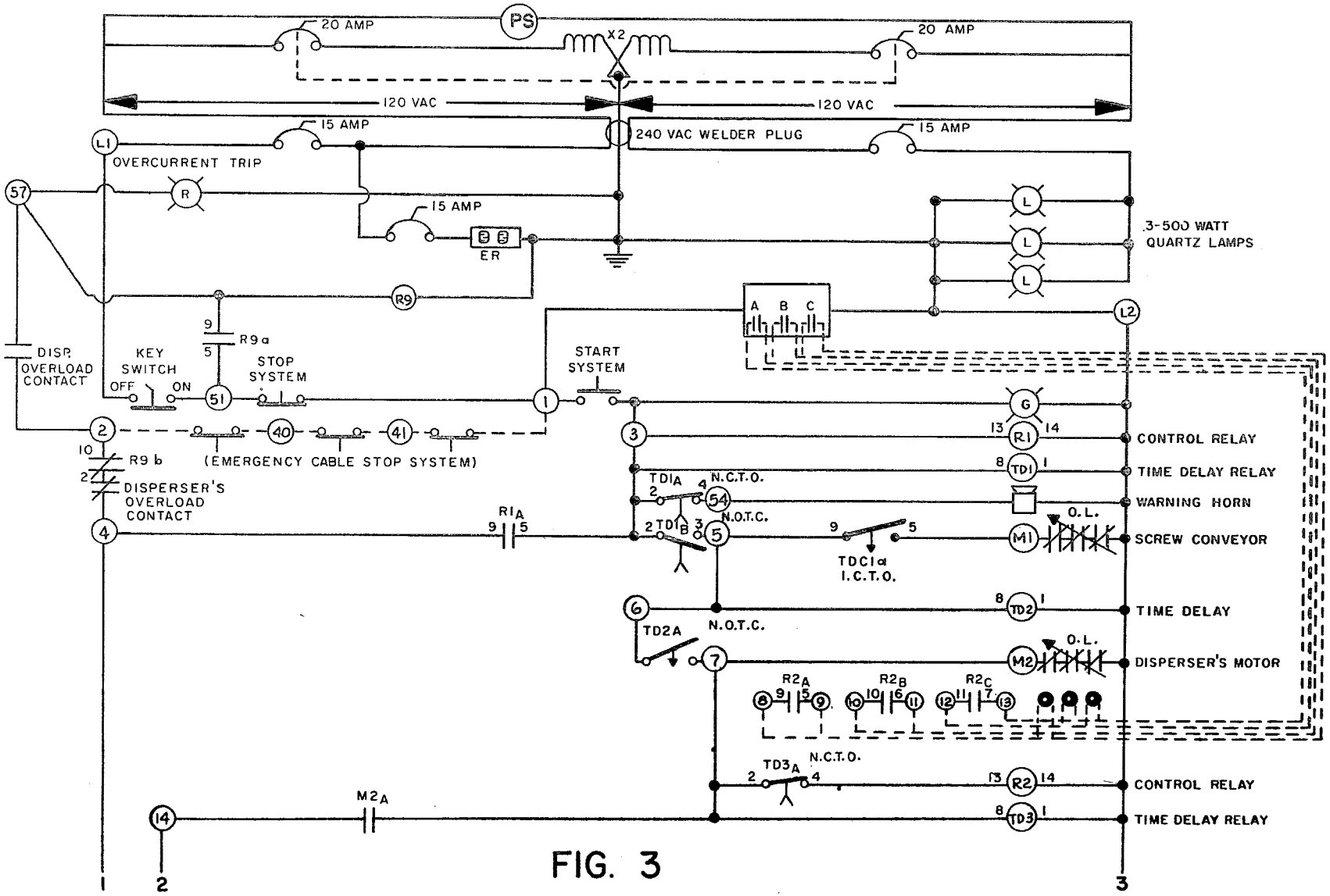

Electrical lines 50 provide power to the apparatus. The lines are supported in draped fashion on support bars 52 for maintaining power during the path of travel of the apparatus. Operator control panels 56, 58, 60, 62, and 64 are located at various locations for operator control of the system as will be described in detail hereinafter. Electrical components visible in FIGS. 1 and 2 include a machine travel limit switch 66 mounted on the apparatus for movement therewith. The machine travel limit switch 66 can contact trip finger 68, located on opposite ends of the pad, only one of which is shown, to limit the path of travel of the apparatus. A similar finger is located at the opposite end of the pad. Limit switch 66 also functions as the low speed limit switch and the high speed limit switch and the feeder home limit switch. Also, located in the top supports of the apparatus adjacent the pivot point of the door is the door down limit switch, the door up limit switch and the door half-way limit switch 70 for determining the door location for the purposes to be described later herein as well as the high speed limit switch.

Lastly, located in a channel beneath the long belt 30 is a long auger 74 for screw conveying any small trash or debris dropped by the long belt or conveyed thereto by cross augers 46. The channel and long auger extend the length of the long belt to deposit conveyed debris and the like to blower 76 for maintaining the mechanical structures of the system clean.

POWER ON

Power is introduced to the circuitry of the instant invention from a source of power, PS, into and along lines L1 and L2. This is in the form of 480 Volt AC at 60 Hertz. A voltage drop occurs across the transformer X2. Two 240 Volt 60 Hert AC components result. Suitable 20 amp breakers and a 240 Volt AC welder plug are provided in the system. Also located on the power panel 56 and for operator convenience, an electrical receptacle, ER, is provided in the circuitry of the apparatus for repair purposes or the like. Power in the system also activates three lamps L through the adjacent 15 amp breaker. The lamps L function as headlights and a back up light for the apparatus. The two 20 amp breakers, in the form of two pole breakers must be powered at this time for any further circuitry to be utilized.

Power to the welder plug is applied before powering any supplemental circuitry. The power at this stage is sufficient to power a small welder without the system running. Suitable 15 amp breakers prohibit the utilization of the welder plug with the control circuit functioning. Without such safety features, utilization of the welder plug concurrently with the rest of the system could cause the transformer X2 to overload and burn out.

KEY SWITCH ON

Start-up is continued by turning the KEY SWITCH on the operator station 64 from the off position as shown to the on position. This provides power to current monitors A, B and C immediately. It also powers a contact adjacent overload safety features including a DISPERSER OVERLOAD CONTACT and a lamp R to be described later. The current monitors A, B and C permit the system to exceed the 40 amp for a short period of time during the initial activation of the system, including start of the DISPERSERS MOTOR M2 which has a high start up current requirement. In this portion of the circuitry, various EMERGENCY CABLE STOP SYSTEM controls are provided on various positions on the apparatus to permit a total shutdown of the machine and trash handling system in the event of a problem. Similarly a stop system button on the operator control panel 64 can also effect such a shutdown.

START SYSTEM

The next operator involvement occurs with the depressing of the START SYSTEM button on the operator station 64 positioned on the feeding apparatus. The depression of the START SYSTEM button permits power to be applied to a green lamp G on the operator panel 64 of the apparatus which will indicate to someone in the vicinity that the machine has been activated. Power is also immediately provided to seal-in contact CONTROL RELAY R1, to a TIME DELAY RELAY TD1 and to a WARNING HORN or panel 56 through closed contact TD1A. The WARNING HORN will sound for about ten (10) seconds to warn people in the vicinity be aware that the apparatus is functioning, parts are moving and the entire system may start its cotton dispersing and feeding function shortly. R1 is a seal-in control relay to close the normally open contact R1A to continue power to the system upon release of the START SYSTEM button.

After an appropriate time delay as determined by TIME DELAY RELAY TD1, the state of contacts TD1A and TD1B will be reversed to stop the action of the WARNING HORN and to activate TIME DELAY RELAY TD2, a second time delay, for about three (3) seconds. Contacts TDC1a and TD1C also close, the former to start the motion of the SCREW CONVEYOR MOTOR M1 and the latter to permit the activation of the long belt by power along lines 35 and 36. Thereafter TD2A closes upon the timing out of TD2 to activate the DISPERSERS MOTOR M2. The DISPERSERS MOTOR powers the disperser rollers which contact and separate the seed cotton from the compacted modules for being fed to the gin.

Upon the closing of contact TD2A, CONTROL RELAY R2 and TIME DELAY RELAY TD3 are also energized. TD3 times out in about 1½ seconds to permit the utilization of current transformers, shown as rings beneath DISPERSERS MOTOR M2 and its overload contacts OL. These current transformers are in a 40:5 ratio in that they accept up to 40 amps and output no more than 5 amps under any circumstances. With R2A, R2B and R2C closed upon the timing out of TD2 the current transformers are shorted out for start up of the DISPERSERS MOTOR M2 thus allowing a start up surge of power drawn to exceed 40 amps during start up. Contacts R2A, R2B and R2C open with the timing out of TD3 permitting M2 to draw its normal 34 amps. Thereafter contacts R2A, R2B and R2C open with the timing out of TD3 and the opening of TD3A. Auxiliary contact M2A is a power permissive for the automatic system which prohibits power to the rest of the system if M2 is not running.

The SCREW CONVEYOR motor M1, through overload contacts OL, is also activated upon the closing of TDC1a and TD1C for movement simultaneous with the movement of the long belt which conveys the seed cotton from the screw conveyor to the gin. The function of the SCREW CONVEYOR is to move dispersed cotton from adjacent the disperser rollers to a long belt for motion toward the gin.

Upon depression of the START SYSTEM button in the automatic mode, AUTO, the opposite position from that as shown in FIG. 4, the operation of the screw conveyor motor can only occur if the long belt and trash system are operational. The long belt motor and the trash system motor become operational through the ginners console becoming activated. However, since the circuit to the long belt and trash systems cannot be completed without a ground return line, the ground return line becomes activated through the depression of the SYSTEM START button and the timing out of TD1 which will close TD1C to complete the ground and permit activation of the trash system motor and the long belt motor by power along lines 35 and 36. At this time the gin plant must be functioning with its controls activated to receive the dispersed and fed seed cotton.

AUTO START-UP

When an operator has decided to operate the instant inventive system in the automatic mode, the switch, located on operator station 64, from the manual, MAN, position as shown in FIG. 4 to the automatic, AUTO, position. With cotton modules on the pad for being dispersed and fed, the AUTO START or RESET button on driver panel 58 is then pressed. A second AUTO START or RESET button may also be provided on the operator panel 64. In the preferred mode of orientation, a module is positioned to block the passage of light across the front electric eye EEF in the front end of the apparatus but positioned to not block the passage of light across the back electric eye EEB in the back end of the apparatus adjacent the dispenser cylinders.

With the front electric eye EEF closed, CONTROL RELAY R3, the door down CONTROL RELAY, is de-energized so that the door won't come down. This in turn allows power to be applied to the back electric eye EEB through the normally closed contact R3*b*. This takes power from point 52 through points 1 and 3 of electric eye EEB if nothing is blocking the light path between the parallel lines 1,2 and 3,4. Power is applied across the triac to point 53, TD8*a* and R6*d* which is normally closed. Power is then applied through limit switch LS1B and M3RA which activates the FORWARD HIGH SPEED motor M3F and also energizes relay B1. Relay B1 activates the HIGH SPEED WARNING BELL adjacent point 38 and the apparatus proceeds forward at high speed until the back electric eye EEB is closed or until TD8 times out opening TD8*a*. The WARNING BELL is also activated in high speed reverse through RELAY B2 which closes M3FB2B and closes M3FB1B which stops power to the slow speed drive clutch. The TD8 timer is a safety feature to insure that an improper light blockage of the front electric eye doesn't indicate to the apparatus that it is yet to reach the first module. Such situation would otherwise improperly permit continued motion of the apparatus at high speed down the pad. The TD8 timer is preferrably of an adjustable time duration. This TD8 timer is a safety feature to preclude a cotton puff or other debris from blocking the front electric eye whereby the apparatus would improperly drive along the pad containing no modules.

At this time M3FB1A closes allowing power to be applied to TD4 and TD4A. After TD4A times out and changes state power is applied to DC1 which in turn applies power to the DC CLUTCH, the low speed forward feed mode for the apparatus. The DC FIELDS is the fields for the DC motor for the low speed drive. The DC CLUTCH is the coupling device for the DC motor and apparatus transmission.

The apparatus continues moving feeding cotton until the front electric eye EEF is made after the last module begins to be dispersed. At this time CONTROL RELAY R3 energizes stepping the PROGRAMMABLE STEPPING SWITCH PSS powering the door to come down. The door comes down with the powering of M4D until the DOOR HALFWAY limit switch LS3A is made. At this time the PROGRAMMABLE STEPPING SWITCH PSS steps again whereby power is applied to terminal 50 energizing the recycle timer RC7 and R7 to pulse the door inward until the module is contained by the door and LS4A, the HIGH SPEED REVERSE limit switch, is made. At this time the repeat cycle timer continues to pulse the door inward but LS4A energizes the REVERSE HIGH SPEED reverse motor M3R.

The feeder apparatus thus backs down the track powered by the REVERSE HIGH SPEED motor M3R until the apparatus arrives at its start or home position where a FEEDER HOME limit switch LS1D activated by element 68 on the pad, is made. The door continues pulsing inward until LS2A, the DOOR DOWN limit switch, is made. At this time the programmable stepping switch PSS steps again until power is applied across 8A 8B of the programmable stepping switch and TD6 timer. After TD6 times out power is applied to the terminal 34 through LS2D to terminal 35. At this time the door raises up until the DOOR UP limit switch LS2C is made at which time the programmable stepping switch steps again and recycles to the restart condition as shown, de-energizing the DC CLUTCH circuit which brings the circuit to idle, its passive condition with the apparatus stopped, until a new module is loaded and the AUTO START or RESET button is depressed again and at which time the above cycle of operation repeats.

In the event that the DISPERSER MOTOR M2 is operated against an overcompacted module or an excess resistive force, then the current draw to the disperser motor is increased to an excess of 40 amps and the solid state current monitors, A, B and C, will be actuated to trip the DISPERSER OVERLOAD CONTACT to disable the entire system in 0.2 seconds. Also, an OVERCURRENT TRIP LAMP R will illuminate to indicate to the operator the source of the shutdown. In order to reset the system again the KEY SWITCH must be turned off, the cause of the overload situation corrected and the KEY SWITCH turned on again. R9 is a seal-in contact relay which acts to close contact R9*a* during an overload condition. When overheating occurs through an overload on the disperser cylinders and their motor, R9 pulls in and contact R9*a* closes and R9*b* by the powering of M4U to inactivate the entire system and seal in R9.

In the optimum situation, the operator would place the modules on the pad with the first module breaking the beam across the front electric eye, EEF, as well as the back electric eye, EEB. In such situation, the depression of the AUTO FEED button would start the relative movement between the apparatus and the modules by starting the apparatus moving in the slow forward mode. As described above, if the front electric eye were broken by the presence of a module but the back electric eye were not, then the depression of the AUTO FEED button would start the apparatus moving in the fast forward mode until the dispenser fingers reached the leading face of the first module and the back electric eye is broken by the presence of the module. At such time the apparatus will shift into the slow forward mode for dispersing and feeding cotton. If, however, the first module is positioned to close neither electric eye, the depression of the AUTO START button will merely cause the door to close and open again while the apparatus remains stationary. When this occurs, the manual mode operation must be employed by depressing the FORWARD HIGH SPEED button to energize M3F to move the apparatus to the first module for operating in the automatic mode. Depressing either the FORWARD HIGH SPEED button or the REVERSE HIGH SPEED button inactivates the clutch which is the forward low speed motion imparter.

MANUAL

In the event that the control system is to be operated in the manual mode, the system is still turned on and activated substantially in the manner as described with respect to the automatic mode. The power is provided to the system from lines L1 and L2 as described above. The KEY SWITCH ON, the various safety features, the EMERGENCY CABLE STOP SYSTEM, etc. also function in the same manner. The START SYSTEM is similar. The principal difference is that in the manual mode both electric eyes, EEF and EEB, are disabled.

Upon pressing the START SYSTEM button with the manual mode MAN selected, the ten second warning buzzer occurs, the M1 Screw Conveyor motor starts and after the time delay of, for example, three (3) seconds, the DISPERSERS MOTOR starts. At this time manual CONTROL RELAYS R5 and R6 are energized since the MAN-AUTO switch is in the manual mode as shown in FIG. 4. This also disables the output of the programmable stepping switch PSS throughout the manual mode operations. The activation of R6 changes the state of R6*b* which then closes. R5 A,B,C and D also change states at this time to the closed position while R6 A, B, C and D also change states. Then the DC CLUTCH energizes after a time delay of three (3) seconds. The apparatus is then in the low speed forward feed mode. In other words, in the manual situation the depression of the START SYSTEM affects both that function as well as the AUTO/START system of the automatic mode. That is why the DC CLUTCH goes straight out since the DC CLUTCH button located on the operator station 64 is for de-energization which can occur in both the automatic and the manual mode.

In the automatic mode, the trash system motor and long belt motor must be running in order for the SCREW CONVEYOR motor to be energized. In the manual mode the trash system or long belt do not need to be running for the SCREW CONVEYOR MOTOR to run. In automatic and manual the trash system and long belt must be enabled in order for the machine to be energized in the low speed forward speed mode.

As the apparatus approaches the end of the last module, the operator will observe the operation and depress the DOOR DOWN segment of the door button. As long as the button is depressed the door will continue to move downwardly. When the finger of the operator is removed the door will stop. The door can be made to go up by depressing the DOOR UP button. With the door all the way down the button may be released and the door will stay down. The operator will then press the REVERSE HIGH SPEED button. As long as he keeps that button depressed, power will be applied to the REVERSE HIGH SPEED motor M3R and the apparatus will return to its home position. The operator may keep one finger on the REVERSE HIGH SPEED and, with another finger, alternately depress the DOOR UP and DOOR DOWN button to continue the dispersing and feeding of cotton while the machine is on the reverse motion towards the home position. Upon reaching home the operator must depress the DC CLUTCH button to preclude the machine from immediately going into the slow forward drive motion. The same principal is true for the FORWARD HIGH SPEED button to move the apparatus into position for the first module to be fed.

The starters for the high speed motor M3 are coupled with an electronic soft start mechanism. Time delay relays TD5 and TD7, with their contacts TD5*a* and TD7*c*, determine the time that the electric soft start needs to time to zero so that full voltage is never instantly applied to drive the motor.

As another safety feature, LS1B on the machine, the machine travel limit switch 66, will contact a fired activator element 68 on the pad at the end of apparatus movement to indicate that the apparatus should go no further down the pad. LS1B allows the FORWARD HIGH SPEED motor circuit to drop out. If the operator is not vigilant and the apparatus reaches the home end of the pad, LS1A closes energizing R4 which de-energizes the DC CLUTCH circuit. Similarly on the return path LS1C on the apparatus is the saving device which couples with the activating device similar to device 68 on the pad at the far end of the pad to drop out the REVERSE HIGH SPEED MOTOR. LS1 A, B, C and D constitute a single limit switch shown as four, for functional purposes, but which has four isolated contacts within the one switch.

LAT B and A are further safety features. They function when the system is operating in the manual mode and an operator switches to the automatic mode. LAT B and A prevent the system from operating in the automatic mode by latching out the programmable stepping switch and indexing it to the start position until the manual cycle has been completed. Relay 28 is a part of the automatic restart permissive circuitry.

OPERATOR CONTROLS

In the event that we have a single pad and module feeding apparatus the controls will include, on the module feeding apparatus at power panel 56, a POWER ON disconnect to bring power from lines L1 and L2 into the system to the circuit breaker box, the welder plug, electrical receptacle, head lights and central power.

Located at the operator station 64 will be the KEY SWITCH ON, the START SYSTEM button, a STOP button and the AUTO/MANUAL select switch. The various buttons for operating the system in the manual mode are also located here.

The third location for buttons is at the driver panel 58 at the end of the module feeding pad. This is to activate the movement of the module feeding apparatus through the AUTO START button being depressed. It is generally pressed by the driver after placing his modules on the pad. In the alternative, the driver's control could be effected through a remote control button from inside his truck.

The fourth station with controls is the ginner's control panel 60. These include the rate of speed control from zero (stop), to 10 (full speed) for motion of the feed rate motors, the air valve switches and an off/on switch.

Lastly on the long belt control panel 62, remote from the apparatus, there will be the trash conveyor and elevator controls and drives. Manual and automatic controls for the long belt may also be provided.

In the event that two pads are operating in the same vicinity off of a common power source and controlled by the same ginner's console, all of the control features described above will be utilized as described above except that either one or both of the feeders may be operated simultaneous and each can go at different speeds and the like based on the ginner's control.

GINNERS CONTROL

Inside the cotton gin there is an operator for controlling the system in either the manual or automatic mode. The operator in this gin has an objective of determining when there is a need to have cotton sent to a cotton receiving receptacle within the gin. The operator, therefore, has a control box with an off-on switch to stop the feeding of cotton as he deems necessary. He also has control over a rheostatic control numbered from 0 to 10. In the zero position it means that cotton is not being fed and the apparatus is in a stand-by position. The fastest that cotton can be fed is when it is dialed 10 on his control. As such the gin operator can control whether or not cotton is sent to the plant and the speed at which it will be received through suction tubes 32. Also located in the cotton gin and mounted within the cotton receiving receptacle may be a limit switch mounted on steady flow. The limit switch is activated only when the receptacle is fully loaded with cotton at which time a signal will be sent to the apparatus to stop the forwarding of further cotton to the receptacle.

In some instances, two parallel receptacles are placed to receive cotton. In such case a split suction from the long belt will draw cotton into each of the two receptacles. When one of the receptacles is full in this operating mode a signal will be sent to forward the cotton at half speed with all of it being directed into the unfilled receptacle. If, however, the second receptacle becomes full and its limit switch detects the full condition a signal will be sent to stop all further movement of cotton to the gin.

TRASH SYSTEM

At the end of the long belt there is a vacuum system 32 for conveying the seed cotton from the belt to the gin as described above. Also at this location there is a point of separation where rocks and green bolls, unopened bolls of cotton from the good cotton, are separated from the vacuumed seed cotton. The speed of the heavier particles, like rocks and the green bolls keeps such particles from being picked up with air. It thus goes out from the belt and into a belt elevator 34 that is on an incline and provided with cleats to accommodate the conveying. These items, rocks and the like, are carried and elevated and dumped, usually into a trailer that the gin would provide. This elevator is provided with an appropriate motor.

On the trash removal system there is also added a bit of machinery that removes trash from the cotton. This trash is dumped from the feeder mechanism into a trench that is underneath the belt conveyor the full length of the pad. In this trench is a screw conveyor 74. This screw conveyor has a motor and conveys the trash that is dumped into it from one end to the other. Trash will dump out of the screw conveyor and trough into a vacuum and go through the vacuum into an air line where fan 34 blows the trash to a remote location.

Suitable electric couplings may be provided in the trash system to inactivate appropriate portions of the system in response to a malfunction within the trash system.

LONG BELT CONTROL

The long belt panel 62 also contains the circuitry for the trash system. The only operating parts on panel 62 are the additional control circuitry and MANUAL OFF/AUTOMATIC selector switch for the long belt 30 and the START/STOP button for the trash system.

In the MANUAL START/STOP for the trash system the long belt control can be run from the outside of the gin in the manual mode or from within the gin in the automatic mode. Its function is to operate the on-off movement of the long belt as well as the trash system. This includes a motor with high and low speed windings for fast and slow speed operation of the long belt. It may also include a safety buzzer and beam along with associated circuitry. The long belt control and the trash system control, when in the manual mode, are substantially passive devices interfacing the ginners console with the above described operator controls.

Assuming that the long belt control is in the automatic position and the KEY SWITCH is on and the START SYSTEM has been depressed, if the ginner than calls for cotton, the operator call is indicated by depressing a free air selector switch from the open to the closed position. Closing the free air valve energizing the DC MOTOR control to run in whatever mode the operator has selected. The motor control operates the feed rate of the feeder itself. At the time the operator closes the selector switch for free air the buzzer and beam are activated as warning devices until TD1A times open. At this time a relay pulls in starting up the trash system. After the trash system is running it permits the long belt to start which in turn permits the SCREW CONVEYOR motor of the feeder to start. If any starter of the trash system drops out it will stop the long belt and stop the screw conveyors of the feeder and stop the forward low speed feed to prohibit any type of system choke-up. The long belt control has several instantaneous closed timers. These permit a warning to occur when the belt is initially started, but prevent a warning when a belt is switching from high to low speeds or vice versa.

Figure 5:
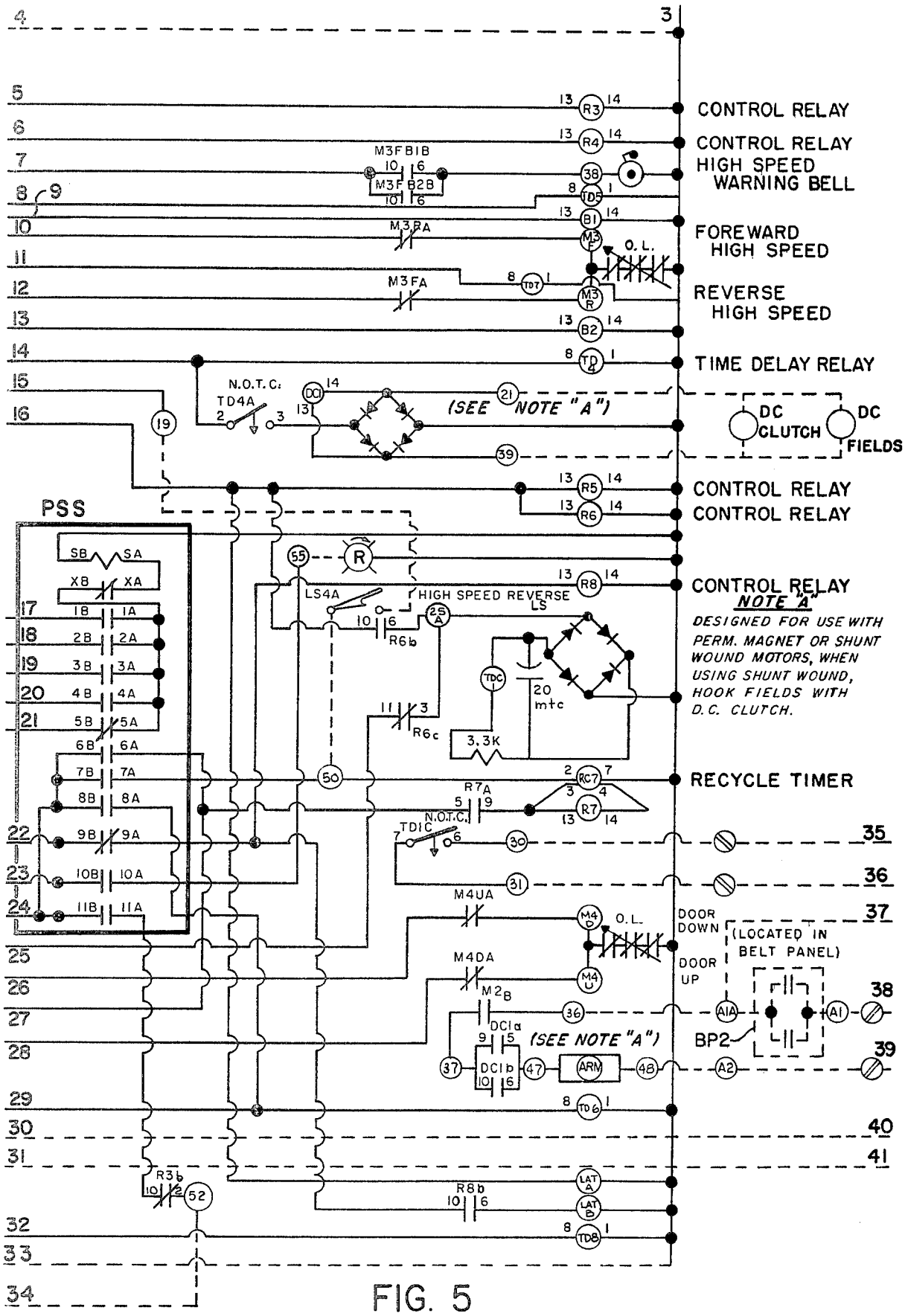

Located within the belt panel are two circuitry components identified on FIG. 4 and 5 as BP1 and BP2. Each includes two normally open contacts which close and are held closed upon the activation and continuation of the long belt motor. They reopen only upon the inactivation of the long belt motor. These contacts are also coupled through the long belt motor with the activating electrical components of the downstream material handling system including the motors driving the pneumatic conveying systems 32 and 74 and the conveying system 34. The purpose of BP1 and BP2 is to provide an additional safety feature in the event of a malfunction in any portion of the downstream material handling components, whether in the nature of an overload, blockage, motor failure or the like. Such malfunction would result in the inactivation of the long belt and the moveable apparatus including the cross augers 30 through the opening of the contacts within BP1 and BP2. Without such safety features, such malfunctions would cause a pile-up of cotton, trash and the like between the moveable apparatus and the end of the long belt adjacent the conveyor 32. In the automatic mode, the opening of all the contacts of BP1 and BP2 will also inactivate all automatic functions associated with the apparatus. In the manual mode, the contacts of BP1 are not functioning to drive the various automatic features of the system. Therefore, the opening of the BP1 contacts will cause no further electrical components to change states. However, since the BP2 contacts are in the functioning circuit driving the apparatus when in the manual mode so that their opening will completely stop the functioning of the moveable apparatus including its movement down the tracks.

While the instant invention is described with regard to a specific embodiment hereof, it is intended to be covered broadly within the spirit and scope of the appended claims.

What is claimed is:

1. A system comprising apparatus for decompacting modules of compacted seed cotton and for feeding the decompacted seed cotton from the apparatus, means to cause relative movement between the modules and said apparatus, module containment means automatically moveable through rotation from a first position out of contact with the modules to be decompacted to a position generally vertical and generally parallel with the trailing face of the last module to be decompacted in response to the trailing face of the last module and said apparatus being located at a predetermined position with respect to each other and means responsive to the position of the moving module containment means to automatically stop the rotational movement of said containment means toward said last module to be compacted.

2. A system comprising apparatus for decompacting seed cotton from compacted cotton modules, drive means to cause relative movement between the modules and said apparatus, module containment means moveable against the trailing face of the last module, detection means to determine the relative position between the apparatus and the trailing face of the last module, additional means to automatically move said module containment means from a first position out of contact with the modules to be decompacted to a position generally vertical against the trailing face of the last module in response to a signal from said detection means and means responsive to the location of the moving module containment means to automatically inactivate said additional means.

3. The system as set forth in claim 2 wherein said detection means includes an electric eye for sensing the trailing face of the last module.

4. The apparatus as set forth in claim 2 wherein said containment means is pivotally mounted on said apparatus.

5. A system for decompacting modules of seed cotton and for conveying the decompacted seed cotton to a remote location for further processing comprising:

(a) moveable apparatus positionable adjacent compacted modules of seed cotton, said moveable apparatus having finger means for decompacting cotton upon contact therewith and said moveable apparatus also having feeder means for moving the decompacted cotton from said fingers to exterior of the moveable apparatus, (b) drive means to transport the moveable apparatus from a home position to and through compacted modules of seed cotton whereby the modules will be decompacted by sdid fingers and the decompacted cotton will then be moved to exterior of the apparatus by the feeder means, (c) conveying means to convey the decompacted cotton from said moveable apparatus to a remote location for further processing, (d) containment means pivotally mounted on said module apparatus and moveable against the trailing face of the last module to be decompacted, (e) control means to sense the position of the moveable apparatus with respect to the trailing face of the last module, (f) means to move the containment means into a generally vertical orientation in contact against the trailing face of the last module for containment purposes in response to a signal from said control means and, (g) means to automatically reverse the direction of movement of the moveable apparatus in response to a further signal from said control means as determined by a predetermined orientation of said containment means having been attained.

6. The system as set forth in claim 5 wherein said control means includes an electric eye mounted on said moveable apparatus for sensing the trailing face of the last module.

7. The system as set forth in claim 5 wherein said control means includes a plurality of electric eyes mounted on said moveable apparatus to permit the fast movement of the module apparatus up to the first module to be compacted and then the slow movement of the movable apparatus during the decompacting of the modules.

8. The system as set forth in claim 5 and further including processing means for handling cotton received from said conveying means.

9. The system as set forth in claim 8 and further including means to inactivate said moveable apparatus in response to a malfunction in said further processing means.

10. A system for decompacting fixedly positioned modules of seed cotton and for conveying the decompacted seed cotton to a remote location for further processing comprising:

(a) apparatus positionable adjacent the compacted modules of seed cotton, said apparatus being moveable and having finger means for decompacting cotton upon contact therewith and said apparatus also having feeder means for moving the decompacted cotton from said fingers to exterior of the apparatus, (b) drive means to cause movement of said apparatus toward and through the compacted modules of seed cotton whereby the modules will be decompacted by fingers and the decompacted cotton will then be moved to exterior of the apparatus by said feeder means, (c) conveying means to convey the decompacted cotton to a remote location for further processing, (d) containment means moveable against the trailing face of the last module to be decompacted, (e) control means to sense the position of the apparatus with respect to the trailing face of the last module, (f) means to move the containment means into contact against the trailing face of the last module for containment purposes in response to a signal from said control means, and (g) means to automatically move said apparatus in the opposite direction in response to said containment means reaching a predetermined position with respect to said apparatus.

11. The system as set forth in claim 10 and further including further processing means to receive cotton from said conveying means.

12. The system as set forth in claim 10 and further including means to inactivate said drive means in response to a malfunction in said further processing means.

* * * * *